United States Patent [19]

Akamatsu et al.

[11] 4,438,915

[45] Mar. 27, 1984

[54] SHEET FEEDING DEVICE

[75] Inventors: Yoshiyuki Akamatsu; Jun Shimogawara, both of Tokyo, Japan

[73] Assignee: Nippon Electric Co., Ltd., Tokyo, Japan

[21] Appl. No.: 417,289

[22] Filed: Sep. 13, 1982

Related U.S. Application Data

[63] Continuation of Ser. No. 155,821, Jun. 2, 1980, abandoned.

[30] Foreign Application Priority Data

Jun. 1, 1979 [JP] Japan ..... 54-69087

[51] Int. Cl.[3] ..... B65H 3/06

[52] U.S. Cl. ..... 271/9; 271/10; 271/22; 271/114; 271/119; 271/DIG. 9

[58] Field of Search ..... 271/21, 114, 119, 121, 271/122, 125, 9, DIG. 9, 225, 127, 3.1, 10, 22

[56] References Cited

U.S. PATENT DOCUMENTS

| | | | |
|---|---|---|---|
| 3,520,533 | 7/1970 | Phelps | 271/127 |
| 3,593,988 | 7/1971 | Collins | 271/119 |
| 3,642,271 | 2/1972 | Davis | 271/116 |
| 3,866,903 | 2/1975 | Eppe et al. | 271/119 |
| 3,944,212 | 3/1976 | Stange | 271/65 |
| 3,961,786 | 6/1976 | Yanker | 271/122 |
| 4,045,015 | 8/1977 | Sardella | 271/119 |
| 4,054,285 | 10/1977 | Stange | 271/DIG. 9 |
| 4,073,585 | 2/1978 | Kobayashi | 271/4 |
| 4,083,555 | 4/1978 | Irvine et al. | 271/116 |
| 4,221,374 | 9/1980 | Koch | 271/4 |

FOREIGN PATENT DOCUMENTS

| | | | |
|---|---|---|---|
| 2033876 | 5/1980 | United Kingdom | 271/119 |

*Primary Examiner*—Richard A. Schacher

*Attorney, Agent, or Firm*—Sughrue, Mion, Zinn, Macpeak & Seas

[57] ABSTRACT

A sheet feeding device is provided with kick-out rollers of generally cylindrical shape having chordal flats. The kick-out rollers are operable to rotate in one direction to deliver a sheet from a sheet stack for forward transport to a printer or the like. The sheet may be reversely transported back to the sheet stack by means of intermediate rollers which direct the sheet between the sheet stack and the chordal flat of the kick-out roller.

7 Claims, 9 Drawing Figures

SHEET FEEDING DEVICE

This is a continuation of application Ser. No. 155,821, filed June 2, 1980 now abandoned.

This invention relates to a sheet feeding device for separating a flat article or sheet from stacked sheets (hereinafter, referred to a sheet stack) and feeding the sheets one by one, and more particularly to a sheet feeding device for use in a computer printer, copying machine and typewriter and the like.

Such a conventional sheet feeding device comprises, as disclosed in the U.S. Pat. No. 4,108,427 entitled "FEEDING DEVICE", a sheet stack housing having on a front side separator pawls, kick-out rollers provided above the sheet stack housing, and a leaf spring provided on the bottom of the housing for pressing the sheet stack to the kick out rollers and the separator pawls. As the kick out rollers rotate, only the uppermost sheet of the sheet stack in contact with the kick out rollers gets over the separator pawls and is fed from the sheet stack housing.

Recently, it is often required that the sheet be transported in the reverse direction in a case where, for example, a graphic printing is performed by a computer printer. In the conventional sheet feeding device, however, the sheet which has been kicked out or is being kicked out can not be transported in the reverse direction or fed back to the sheet stack housing. Therefore, the feeding device must be located apart from the printing position. This causes the printer to be large.

It is, therefore, an object of this invention to provide an improved sheet feeding device in which a sheet already kicked out can be fed back to a sheet stack housing.

It is another object of this invention to provide a compact printer in which a sheet can be fed in both directions.

According to this invention, there is provided a sheet feeding device comprising: a sheet stack housing for housing stacked sheets, said sheet stack housing having a pair of separator pawls and means for pressing said stacked sheets to said separator pawls; kick out roller means provided above said sheet stack housing for kicking out the uppermost sheet from said stacked sheets, said kick out roller means having a circular segment cross section; and clutch means for selectively transmitting a one way rotation force to said kick out roller means.

The features and advantages of this invention will be better understood from the following description of a preferred embodiment of this invention taken in conjunction with the accompanying drawings, wherein.

Figure 1:
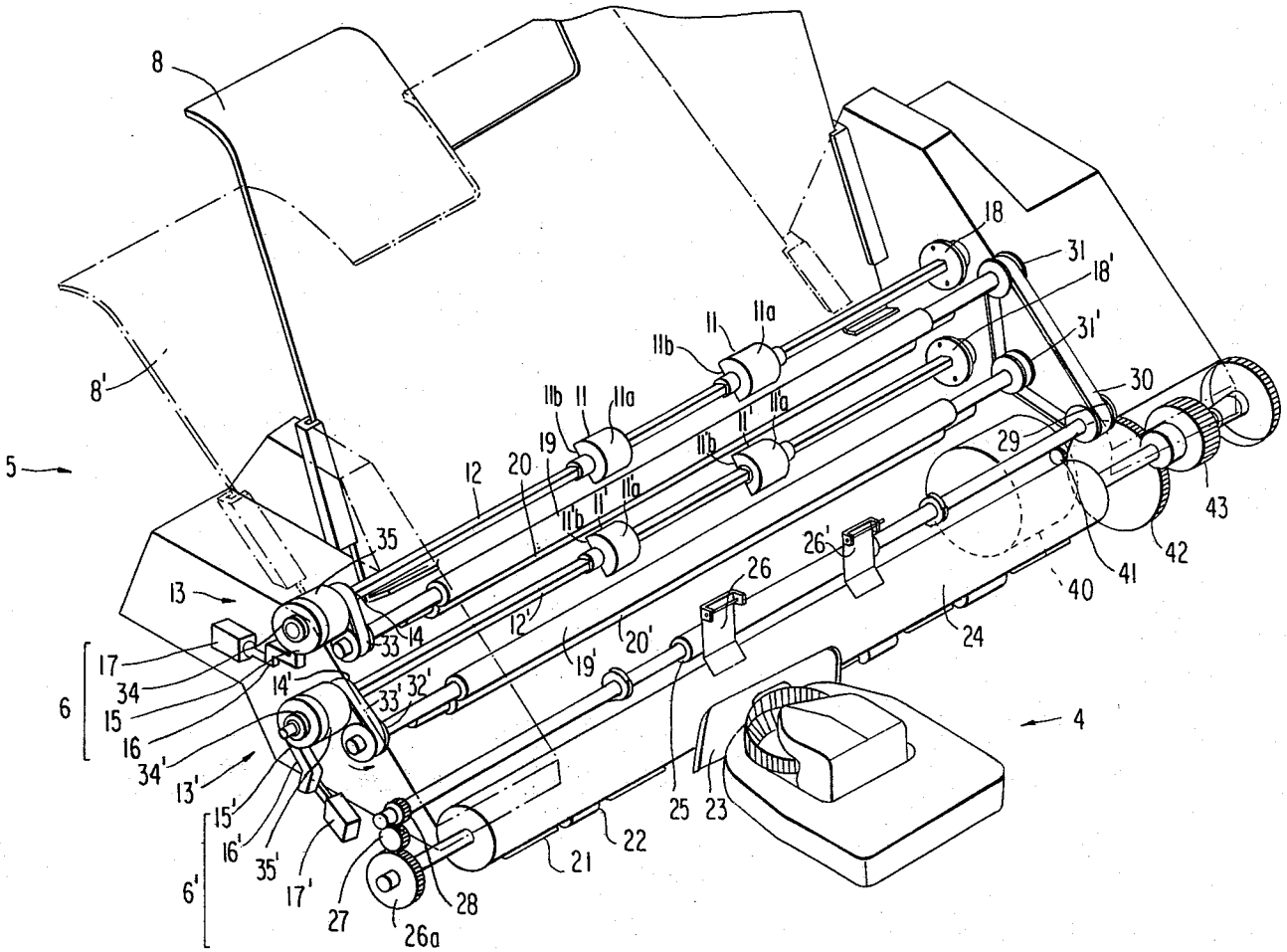
FIG. 1 is a perspective view of an embodiment of this invention.
Figure 2:
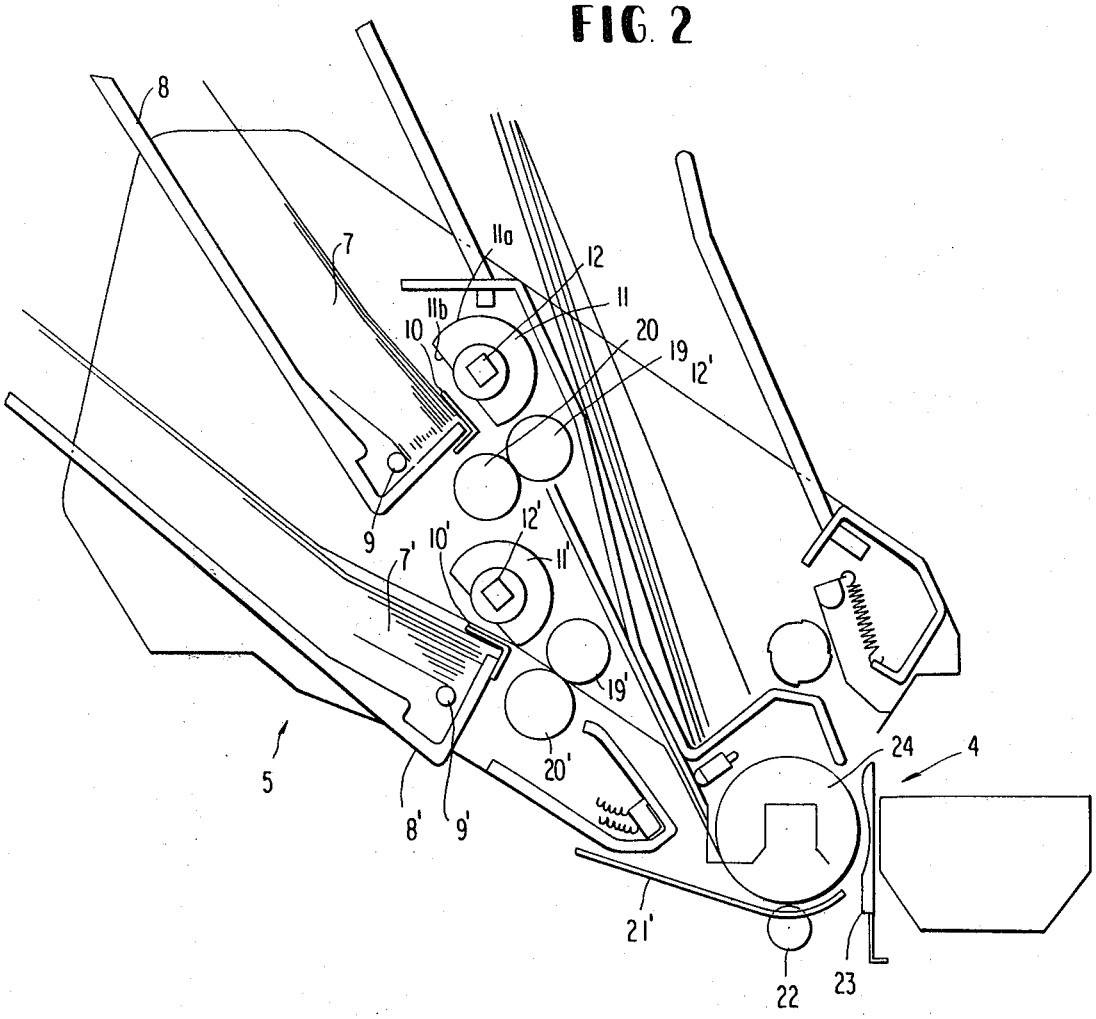
FIG. 2 is a side view of the embodiment shown in FIG. 1.

Referring to FIGS. 1 and 2, a printer 4 comprises a sheet feeder section 5 according to an embodiment of this invention. The sheet feeder 5 is made of two sheet feeders 6 and 6' having sheet stack housings 8 and 8', respectively. Sheet stacks 7 and 7' are held in the sheet stack housings 8 and 8', and pressed to separator pawls 10 and 10' by pressure levers 9 and 9' actuated by springs (not shown), respectively. Kick out rollers 11 and 11' each having a circular segment cross-section are provided above the housings 8 and 8' and comprise arc portions 11*a* and 11*a'* in contact with the sheet stacks 7 and 7', and chord portions 11*b* and 11*b'*, respectively. Axes 12 and 12' of the rollers 11 and 11' are fixed to follower portions 34 and 34' of clutches 13 and 13'. Driving gears 14 and 14' are provided on the driver portions 35 and 35' of the clutches 13 and 13', respectively. The clutches 13 and 13' comprises pawls 15 and 15' connected to levers 16 and 16' which are swung by magnets 17 and 17', respectively. One-way clutches 18 and 18' provided on the other sides of the axes 12 and 12' of the rollers 11 and 11', respectively.

Feed rollers 19 and 20, and 19' and 20' provided near the kick out rollers 11 and 11' feed the kicked out sheets from the feeders 6 and 6' to the platen 24 and vice versa. The sheet fed from the feeder 6 or 6' is passed along the platen 24 with the aid of a paper guide 21, a pressure roller 22 and a card holder 23 and then fed between a roller 25 and guide plates 26 and 26'. The platen 24 is rotated by a line feed motor 40 through gears 41, 42 and 43. The motor 40 drives the roller 25 through a platen gear 26 coupled to the platen 24, an idler gear 27 and a roller driving gear 28. A gear 29 coupled to the other end of the roller 25 is coupled to feed-roller driving gears 31 and 31' through the synchro-belt 30 to rotate the feed rollers 19 and 19', respectively. Gears 32 and 32' on the other ends of the feed rollers 19 and 19' drive the driving gears 14 and 14' of the clutches 13 and 13' through synchro-belts 33 and 33', respectively.

Figure 3:
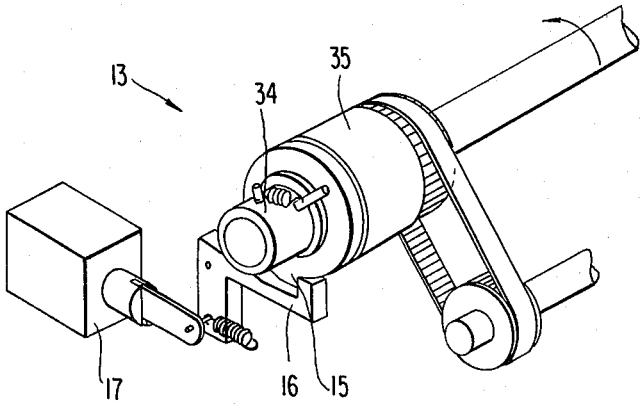
FIG. 3 is a perspective view of a clutch portion in the embodiment shown in FIG. 1.
Figure 4A:
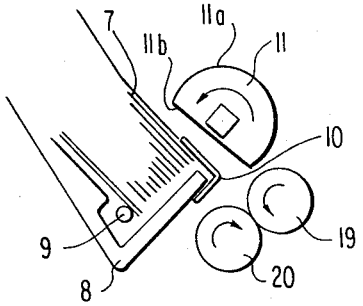
FIGS. 4(*a*) through 4(*f*) illustrate the operation of the embodiment shown in FIG. 1.
Figure 4B:
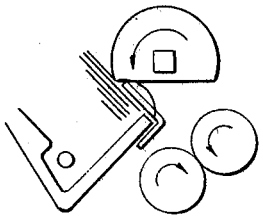
Figure 4C:
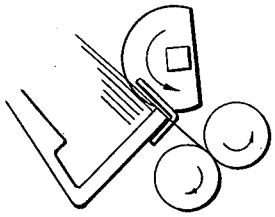
Figure 4D:
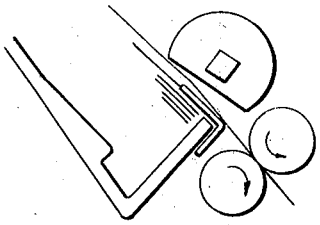
Figure 4E:
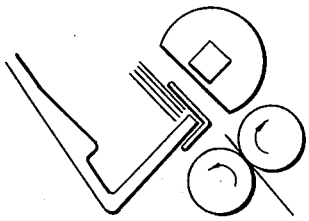
Figure 4F:
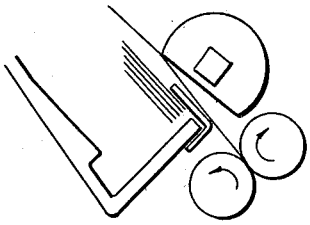

The operation of the clutch 13 will be described with reference to FIG. 3. The clutch 13 is operationally divided into the driver portion 35, the follower portion 34 and pawl 15. The driver portion 35 drives the follower portion 34 to rotate the axis 12 of the roller 11 in only the direction depicted by the arrow A when the pawl 15 is free, i.e., when the magnet 17 is operated and the lever 16 is separated from the pawl 15 to become free. The driver portion 35 does not drive the follower portion 34 when the magnet 17 is not operated and the lever 16 is pressed to the clutch 13 by a spring.

Referring again to FIGS. 1 and 2, the sheet feeding is started by operating the magnet 17 or 17'. When the magnet 17 is operated, the roller 11 is started to rotate. As clearly shown in FIGS. 4(*a*) through 4(*f*), the roller 11 whose chord portion 11*b* is against to the sheet stack 7 (FIG. 4(*a*) contacts its arc portion 11*a* with the sheet stack 7 to kick out the uppermost sheet in cooperation with the separator pawls 10 (FIGS. 4(*b*) and 4(*c*). The kicked out paper is inserted between the rollers 19 and 20 to be fed (FIG. 4(*d*)). After one revolution of the clutch 13, the lever 16 is again coupled to the pawl 15 of the clutch 13 to stop the rotation of the roller 11 under the state that chord 11*b* is placed confronting the sheet stack 7 and such state is maintained until the magnet 17 is again operated. The one-way clutch 18 coupled to the axis of the roller 11 cooperates for maintaining such state. The sheet fed from the feeder section 5 is passed through the sheet feed route to the platen 24 on which the printing is achieved.

When it is required to feed the sheet fed from the feeder section 5 to the platen 24 back to the feeder section 5 in the case, for example, of graphic printing, the platen 24, and the feed rollers 19 and 20 are rotated in the reverse direction and the fed back sheet is passed through the gap between the sheet stack 7 and the chord portion 11*b* of the roller 11, as shown in FIGS. 4(*e*) and 4(*f*).

Thus, in the illustrated embodiment, the feeder section 5 can be located near the printing position, making it possible for the printing apparatus to be compact.

What is claimed is:

1. A sheet feeding device, comprising:

a sheet stack housing for housing stacked sheets, said sheet stack housing having a pair of separator pawls and means for pressing said stacked sheets against said separator pawls;

kick-out roller means provided above said sheet stack housing for kicking out and feeding an uppermost sheet from said stacked sheets, said kick-out roller means having a circular segment cross section and a chordal flat;

means for rotating said kick-out roller in a transporting direction from said sheet stack housing;

clutch means for selectively transmitting a one-way rotational force to said kick-out roller means;

bi-directionally rotatable feed rollers located proximate to said kick-out roller means for further feeding said sheet kicked out and fed from said sheet stack housing and for return feeding said sheet to said sheet stack housing; and drive means for driving said feed rollers in one direction to deliver a sheet from said sheet stack housing, and in the reverse direction to deliver said sheet back to said sheet stack housing.

2. A sheet feeding device according to claim 1, wherein said means for pressing said stacked sheets against said separator pawls comprises spring actuated pressure levers.

3. A sheet feeding device according to claim 1, wherein said clutch means further includes a driver means and follower means, said follower means being driven by said driver means when said driver means rotates in one direction.

4. A sheet feeding device according to claim 3, wherein said follower means remains idle when said driver means is driven in the reverse direction.

5. A sheet feeding device, comprising:

a sheet stack housing for housing stacked sheets, said sheet stack housing having a pair of separator pawls and means for pressing said stacked sheets against said separator pawls;

kick-out roller means provided above said sheet stack housing for kicking out and feeding an uppermost sheet from said stacked sheets, said kick-out roller means having a circular segment cross section;

means for rotating said kick-out roller in a transporting direction from said sheet stack housing;

clutch means for selectively transmitting a oneway rotational force to said kick-out roller means;

bi-directionally rotatable feed rollers located proximate to said kick-out roller means for further feeding said sheet kicked out and fed from said sheet stack housing and for return feeding said sheet to said sheet stack housing; and driver means for driving said feed rollers in one direction to deliver a sheet from said sheet stack housing, and in the reverse direction to deliver said sheet back to said sheet stack housing, said feed rollers being operable to deliver a sheet to said sheet stack housing when a chordal flat of said kick-out roller means is in confronting relation with said stacked sheets, said sheet being passed between said sheet stack and said chordal flat.

6. A sheet feeding device, comprising:

a sheet stack housing for housing stacked sheets, said sheet stack housing having a pair of separator pawls and means for pressing said stacked sheets against said separator pawls;

kick-out roller means provided above said sheet stack housing for kicking out and feeding an uppermost sheet from said stacked sheets, said kick-out roller means including a cylindrical roller having a chordal flat, said chordal flat being positioned above and confronting said stacked sheets when the roller is stationary;

means for rotating said kick-out roller in a transporting direction for said sheet stack housing;

clutch means for selectively transmitting a oneway rotational force to said kick-out roller means;

bi-directionally rotatable feed rollers located proximate to said kick-out roller means for further feeding said sheet kicked out and fed from said sheet stack housing and for return feeding said sheet to said sheet stack housing; and driver means for driving said feed rollers in one direction to deliver a sheet from said sheet stack housing, and in the reverse direction to deliver said sheet back to said sheet stack housing.

7. A sheet feeding device, comprising:

a sheet stack housing for housing stacked sheets, said sheet stack housing having a pair of separator pawls and means for pressing said stacked sheets against said separator pawls;

kick-out roller means provided above said sheet stack housing for kicking out and feeding an uppermost sheet from said stacked sheets, said kick-out roller means having a circular segment cross section;

means for rotating said kick-out roller in a transporting direction from said sheet stack housing;

clutch means for selectively transmitting a oneway rotational force to said kick-out roller means, said clutch means including a pawl and a lever, and magnet actuator means operable to move said lever into or out of engagement with said pawl;

bi-directionally rotatable feed rollers located proximate to said kick-out roller means for further feeding said sheet kicked out and fed from said sheet stack housing and for return feeding said sheet to said sheet stack housing; and driver means for driving said feed rollers in one direction to deliver a sheet from said sheet stack housing, and in the reverse direction to deliver said sheet back to said sheet stack housing.

* * * * *

UNITED STATES PATENT AND TRADEMARK OFFICE

CERTIFICATE OF CORRECTION

PATENT NO. : 4,438,915

DATED : March 27, 1984

INVENTOR(S) : Yoshiyuki Akamatsu et al

It is certified that error appears in the above-identified patent and that said Letters Patent is hereby corrected as shown below:

Column 1, line 25, delete "a" (first occurrence)

Column 1, line 28, change "can not" to --cannot--

Column 2, line 13, before "provided", insert --are--

Column 2, line 49, change "4(a)" to --(4a))--

Column 2, line 51, change "4(c)" to -- 4(c))--

Column 3, line 54, change "oneway" to --one-way--

Column 4, line 24, change "oneway" to --one-way--

Column 4, line 46, change "oneway" to --one-way--

Signed and Sealed this

*Nineteenth* Day of *March 1985*

[SEAL]

*Attest:*

DONALD J. QUIGG

*Attesting Officer* *Acting Commissioner of Patents and Trademarks*